US012702234B2

(12) United States Patent
Boyington et al.

(10) Patent No.: US 12,702,234 B2
(45) Date of Patent: Aug. 11, 2026

(54) SWAYBILIZER SWING ARMS FOR ATTACHMENT TO A CHAIR

(71) Applicant: Project 3 Products, LLC., Vero Beach, FL (US)

(72) Inventors: Richard J. Boyington, Vero Beach, FL (US); Joseph S. Wyatt, Melbourne, FL (US); Julianne E. Wyatt, Melbourne, FL (US)

(73) Assignee: Project 3 Products, LLC., Vero Beach, FL (US)

( * ) Notice: Subject to any disclaimer, the term of this patent is extended or adjusted under 35 U.S.C. 154(b) by 159 days.

(21) Appl. No.: 18/430,005

(22) Filed: Feb. 1, 2024

(65) Prior Publication Data

US 2024/0251954 A1 Aug. 1, 2024

Related U.S. Application Data

(60) Provisional application No. 63/462,331, filed on Apr. 27, 2023, provisional application No. 63/442,738, filed on Feb. 1, 2023.

(51) Int. Cl.
*A47C 7/54* (2006.01)

(52) U.S. Cl.
CPC ..... *A47C 7/543* (2013.01)

(58) Field of Classification Search
CPC ..... A47C 7/541; A47C 7/543; A47C 7/546; A47C 7/68
See application file for complete search history.

(56) References Cited

U.S. PATENT DOCUMENTS

| | | | | |
|---|---|---|---|---|
| 2,804,126 | A * | 8/1957 | Palmer | A47C 7/705 D6/707.22 |
| 2,844,193 | A | 7/1958 | Lauterbach | |
| 2,900,011 | A | 8/1959 | Casey | |
| 5,282,671 | A * | 2/1994 | Funk | A47C 7/624 297/145 |
| 5,297,021 | A * | 3/1994 | Koerlin | A61G 5/12 297/354.12 |
| 5,407,249 | A | 4/1995 | Bonutti | |
| 5,490,710 | A | 2/1996 | Dearing et al. | |
| 6,715,836 | B1 * | 4/2004 | Chen | A47C 1/03244 297/411.39 |
| 2004/0070251 | A1 | 4/2004 | Roney et al. | |
| 2005/0274857 | A1 | 12/2005 | Gevaert | |

(Continued)

*Primary Examiner* — Tye William Abell
(74) *Attorney, Agent, or Firm* — John L. DeAngelis; Wolter Van Dyke Davis, PLLC

(57) ABSTRACT

A chair. Left and right adjustable swing arms are attached to the chair back and each is moveable between a rest position at about 90 degrees relative to the chair back and an extended position at about 180 degrees relative to the chair back. The left and right adjustable swing arms each further comprise an arm rest and an arm rod. Each rod defines a first segment and a second segment at 90 degrees relative to the first segment. The first segment of each arm rod is disposed longitudinally within the left arm and right arm rests. A left and a right swing arm support is attached to the chair back with the second segment of each arm rod is pivotably mounted to the respective left and right swing arm supports to allow the left and right swing arms to pivot between the rest position and the extended position.

10 Claims, 13 Drawing Sheets

(56) References Cited

U.S. PATENT DOCUMENTS

| | | | | |
|---|---|---|---|---|
| 2006/0076818 | A1* | 4/2006 | LaFreniere | A47C 7/546<br>297/411.36 |
| 2006/0103180 | A1 | 5/2006 | Brown | |
| 2006/0103221 | A1 | 5/2006 | Kleist | |
| 2006/0202527 | A1 | 9/2006 | Viger | |
| 2008/0203802 | A1* | 8/2008 | LaFreniere | A47C 7/40<br>297/411.35 |
| 2009/0236165 | A1* | 9/2009 | Kramer | A47K 3/281<br>180/200 |
| 2011/0031785 | A1* | 2/2011 | Steenson | A47C 7/543<br>297/161 |
| 2017/0020753 | A1 | 1/2017 | Boretto et al. | |
| 2018/0214325 | A1 | 8/2018 | Van de Wal et al. | |
| 2019/0029440 | A1 | 1/2019 | Schmitz et al. | |
| 2022/0400865 | A1 | 12/2022 | Lawson | |
| 2022/0408931 | A1 | 12/2022 | Pavlov | |

* cited by examiner

SWAYBILIZER SWING ARMS FOR ATTACHMENT TO A CHAIR

CROSS REFERENCE TO RELATED APPLICATIONS

The present application claims priority under 35 U.S.C. 119(e) to the provisional patent application filed on Feb. 1, 2023 and assigned application No. 63/442,738 and to the provisional patent application filed on Apr. 27, 2023 and assigned application No. 63/462,331. Both provisional applications are incorporated in their entirety herein.

BACKGROUND OF THE INVENTION

Today's conventional chairs are constructed with permanently fixed arms perpendicular to the back surface of the chair. To rest her arms, the user must of course set her arms atop the chair arms. While this arrangement may be satisfactory in most situations, one can imagine that occasionally the user may wish to extend her arms to the side at a different angle, but current chairs cannot accommodate any angle aside from 90 degrees. The present invention overcomes this limitation.

BRIEF DESCRIPTION OF THE DRAWINGS

The present invention can be more easily understood and the advantages and uses thereof more readily apparent when the detailed description of the present invention is read in conjunction with the figures wherein.

In accordance with common practice, the various described features are not drawn to scale, but are drawn to emphasize specific features relevant to the invention. Like reference characters denote like elements throughout the figures and text.

DETAILED DESCRIPTION OF THE INVENTION

The present invention comprises swing arms that can be affixed to an existing chair (and further comprises a chair with swing arms), such that an angle between the arms and the chair back can be adjusted to place the arms in-line with the chair back (that angle referred to herein as 180 degrees and referred to as an extended or wing-like position) or perpendicular to the chair back (that angle referred to herein as 90 degrees or referred to as a rest position) or to any angle between 90 and 180 degrees. This configuration of the inventive chair is in contrast to the prior art, wherein the arms are fixedly perpendicular to the chair back.

With the chair arms in this wing-like orientation (i.e., at 180 degrees relative to the chair back), they serve as a swinging arm rests, allowing the sitting user to swing his/her arms out horizontally in a spread wing-like fashion.

In one embodiment, the arms are attached to a rear surface of the chair back proximate a vertical edge of the chair back. In one embodiment the swing arms are also stowed along this rear surface. The arms can be swung out from this stowed position in a circular arc, allowing the user to rest her/his arms at different positions within this circular arc. Obviously, such a displacement of the chair arms cannot be accomplished with a standard chair with fixed arms.

According to another embodiment, the swinging arms are pivotably attached to arms of an existing chair. Like the embodiment described immediately above, the arms can be rotated or pivoted from a rest position immediately above the existing chair arms to a wing-like position. The inventive swing arms can be added to any style chair and chair material. And the modified chair can be used in many different environments and applications, such as home, recreation, office, hospital, nursing homes, rehabilitation and occupational therapy centers.

The benefits of the swinging chair arms include therapeutic comfort, relief to the neck and shoulder muscles, as well as stress relief from the arms and upper torso.

As further described below and illustrated in the Figures, the principle parts of the various Swaybilizer swing arm chair embodiments (where Swaybilizer is a reference to the commercial product) include: two adjustable swing arm rests, two swing arm rest rods, two lengths of thermoplastic tubing, four magnets and mounting components for the magnets, two pillow-balls with threaded shafts, two pillow ball cases, and associated mounting hardware.

Generally, certain embodiments are intended for use by chair manufacturers as the required components can be easily included in a novel and non-obvious chair design. Other embodiments are intended for attachment to an existing chair, such as the embodiment represented by FIGS. 6 and 7. The components required for this latter embodiment are easily installed by the chair owner.

However, elements of either embodiment can be used in conjunction with a swing arm of a different embodiment.

Figure 1:
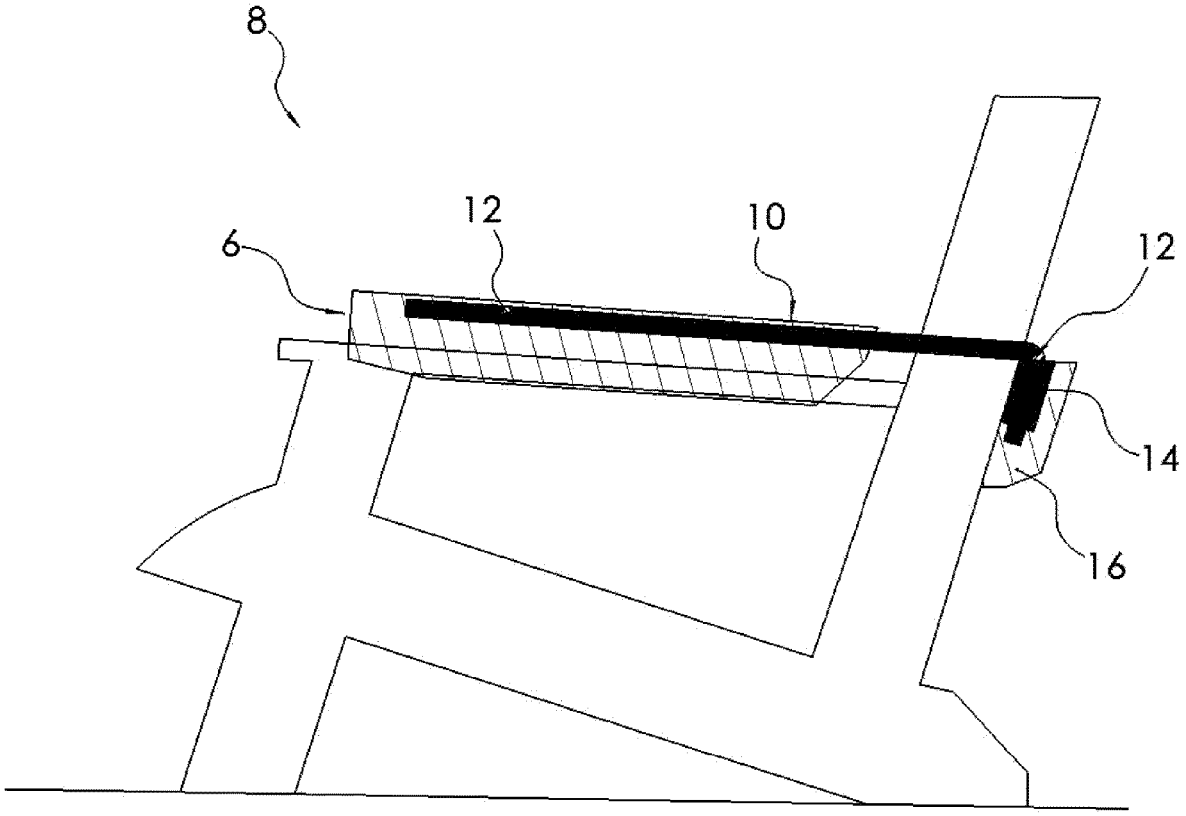
FIG. 1 is a side view of a chair with swing arms constructed according to one embodiment of the present invention.

FIG. 1 illustrates the principal components of a conventional chair 8 including the Swaybilizer swing arms. The swing arm components can be designed as integral functional elements of a chair by the manufacturer, mounted to a chair by the chair manufacturer after construction of the chair has been completed, or mounted by the chair owner as aftermarket parts.

As shown in FIG. 1, a Swaybilizer adjustable swing arm 6 (illustrated on a left side of a chair 8) comprises arm rests 10, arm rest rods 12 disposed within the arm rest 10, a thermoplastic tube 14, and swing arm supports 16. Identical swing arm elements are disposed on an opposing right side of the chair 8.

Figure 2:
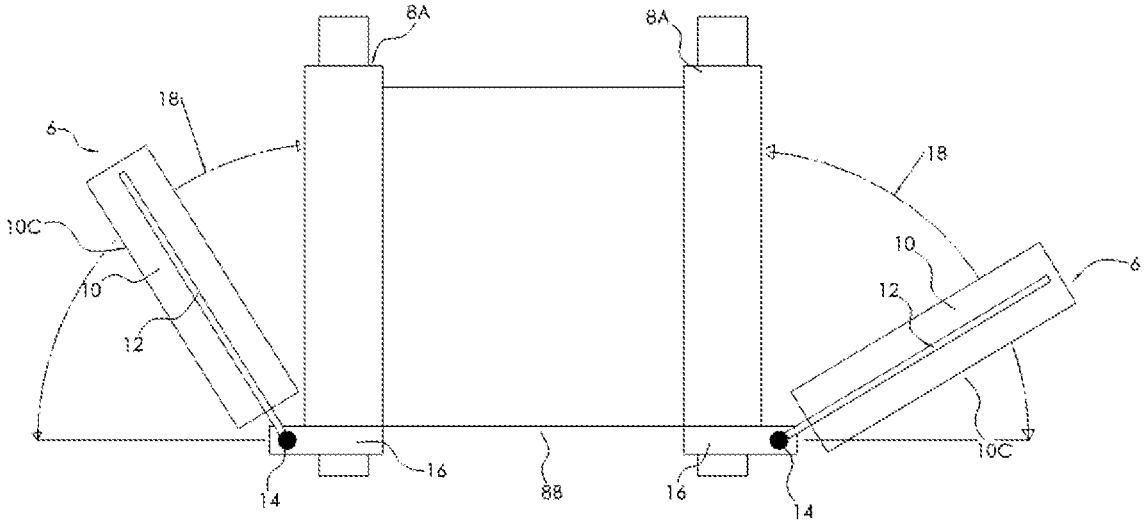
FIG. 2 is a top view of the chair of FIG. 1 showing the swing arms rotated from their rest position.

FIG. 2 is a top view of the chair 8 with each swing arm 6 extended from a rest position atop conventional arms 8A of the chair 8. Each swing arm 6 is illustrated at a different angle relative to the conventional arms 8A. Each swing arm 6 can be adjusted to any point along a circular arc 18. The swing arms can be stored along a chair back surface 8B For an office chair, the arm rests 10 can be of conventional construction comprising a cushion material encased within an outer durable fabric-like material. Alternatively, the arm rests comprise silicone padding that features soft, wave-like, knurled ridges as a non-slip comfortable surface for outdoor recreational chairs. Optionally, the arm rests 10 may be of simple wood construction and sanded to a smooth finish for use with wooden chairs. The construction and materials of the arm rests are obviously the chair manufacturer's choice.

The swing arm supports 16 can be manufactured as bolt-on components to a conventional chair, molded directly into a plastic chair structure, or stamped into metal chair structure. The swing arm supports can also be 3D printed. The precise location of swing arm supports 16, proper bracing, and material choices is variable according to the manufacturer's plans and specific structural features of the chair to which the swing arm supports are attached.

Figure 3:
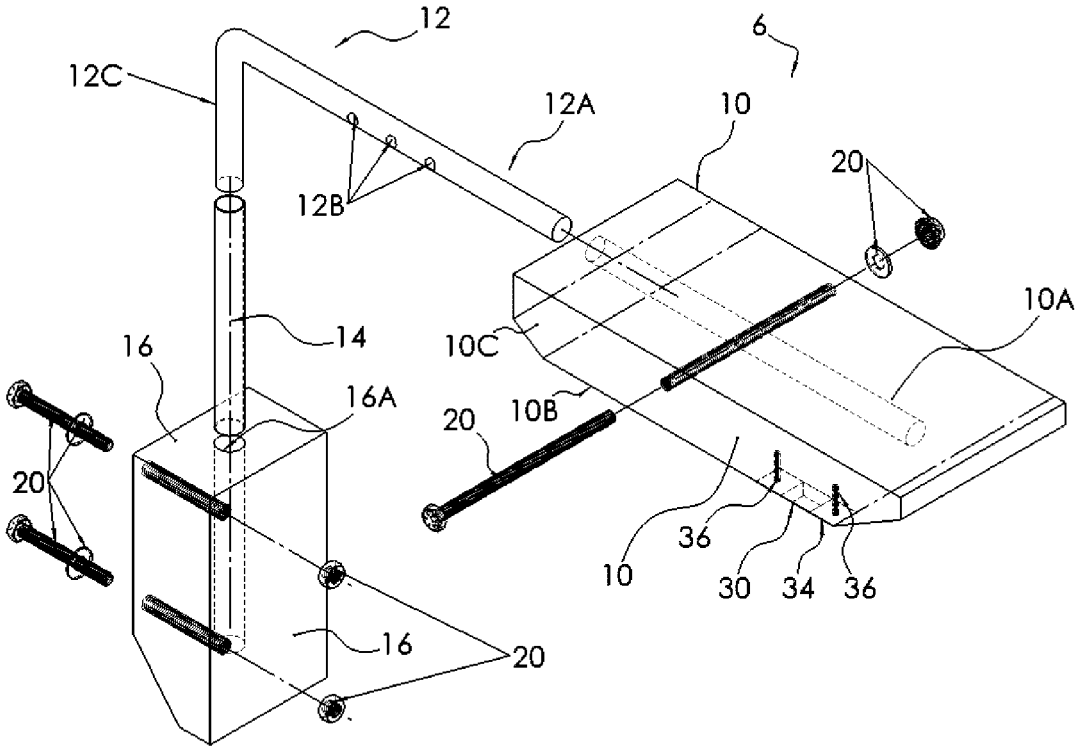
FIG. 3 shows components for attaching a swing arm to an existing chair.

FIG. 3 depicts additional details of the swing arms of FIGS. 1 and 2.

In one embodiment, a length 12A of the arm rest rod 12 is inserted into an opening 10A in the arm rest 10. The rod is secured in place by mounting hardware, e.g., bolts and mating nuts 20. The location of the arm rest 10 along the length 12A of the swing arm rest 12 is adjustable to suit the user's arm length. This adjustment feature is accomplished by selecting one of openings 12B in the swing arm 12 for receiving the bolt and mating nut combination.

In an alternative embodiment the arm rest 10 and the swing arm rod 12 are molded as a single piece.

Continuing with FIG. 3, a bent segment 12C of the swing arm rest rod 12 slides into a thermoplastic tube 14. The assembly of the thermoplastic tube 14 and the bent length 12C are inserted into a mounting hole 16A in the swing arm support 16. The thermoplastic tube introduces frictional forces between the bent segment 12C and the mounting hole 16A. The friction forces prevent the arms from swinging too freely. The friction forces are caused by the coefficients of friction between a material of the thermoplastic tube, a material of the bent segment 12C, and a material of the swing arm support 16.

In one embodiment, a material for the thermoplastic tube 14 comprises thermoplastic acrylic-polyvinyl chloride. This material exhibits a smooth surface, is durable, and offers wear-free operation, while providing sufficient frictional forces to restrain the rod from swinging freely.

A magnet 30 (see FIG. 3) is secured to a bottom (or side) surface 10B of the arm rest 10 using a mounting plate 34 and mounting hardware 36 (screws, for example). Other techniques and mounting components can be used to secure a magnet to each arm rest. The magnets are mounted on the bottom surface 10B of the arm rest 10 and flush with the outboard surface 10C. The outboard surface 10C is also identified in the top view of FIG. 2.

Figure 4:
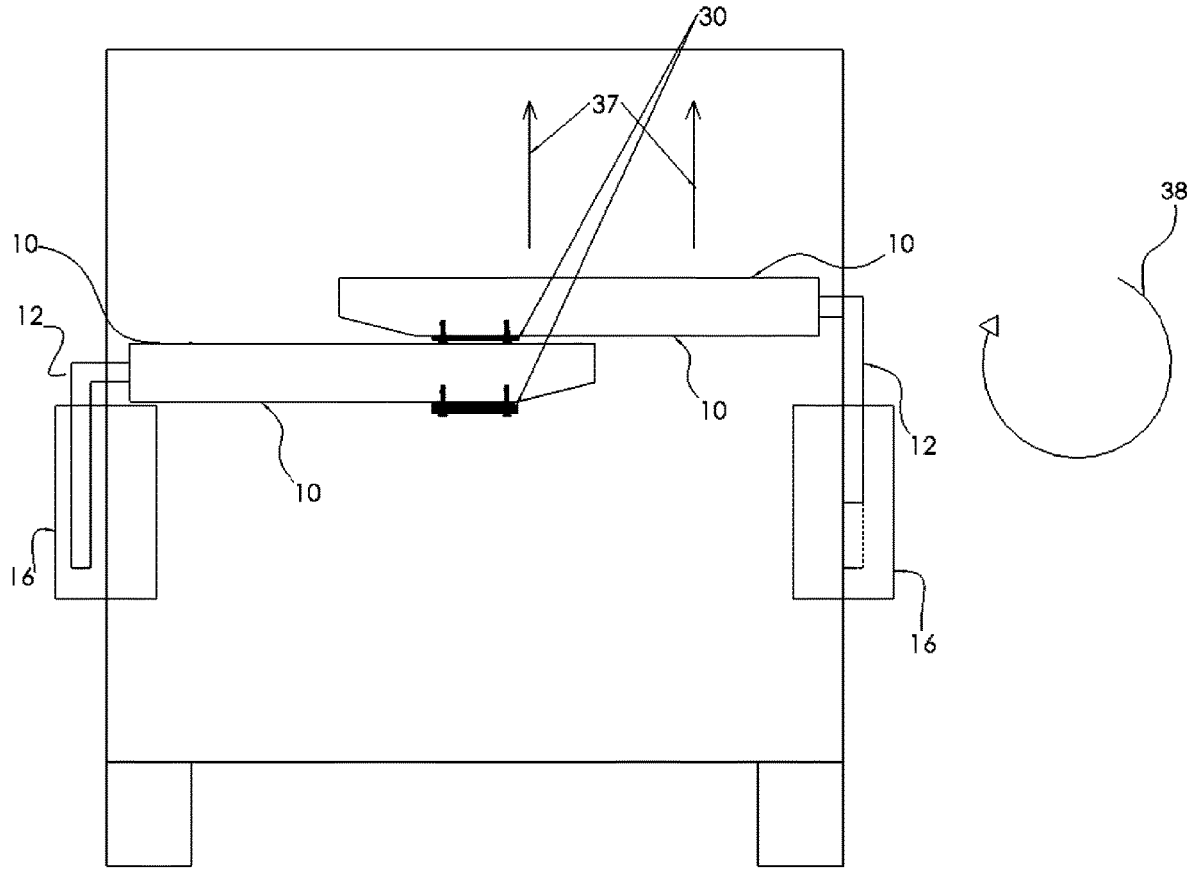
FIG. 4 depicts the swing arms in a stowed configuration behind the chair back.

As shown in the rear view of the chair in FIG. 4, the Swaybilizer swing arms are stowed safely behind the chair back for compact storage. To move the swing arms into the stowed location, a user rotates one of the swing arms to the rear of the chair until the magnet 30 (see FIG. 3) on the swing arm magnetically engages a magnet on the rear surface of the chair (not visible in FIG. 4). The user then rotates the second swing arm to the rear of the chair, while lifting it slightly upwardly (as represented by arrowheads 37) to clear the first swing arm and again magnetically couple the two magnets.

An arrowhead 38 represents rotation of the swing arms from their rest position extending perpendicular to the chair back to their stowed position behind the chair back.

FIG. 4 illustrates the magnets 30 attached to the chair arms, i.e., attached to the bottom surface 10B and flush with the outboard surface 10C (see FIG. 2) of each arm.

Figure 5:
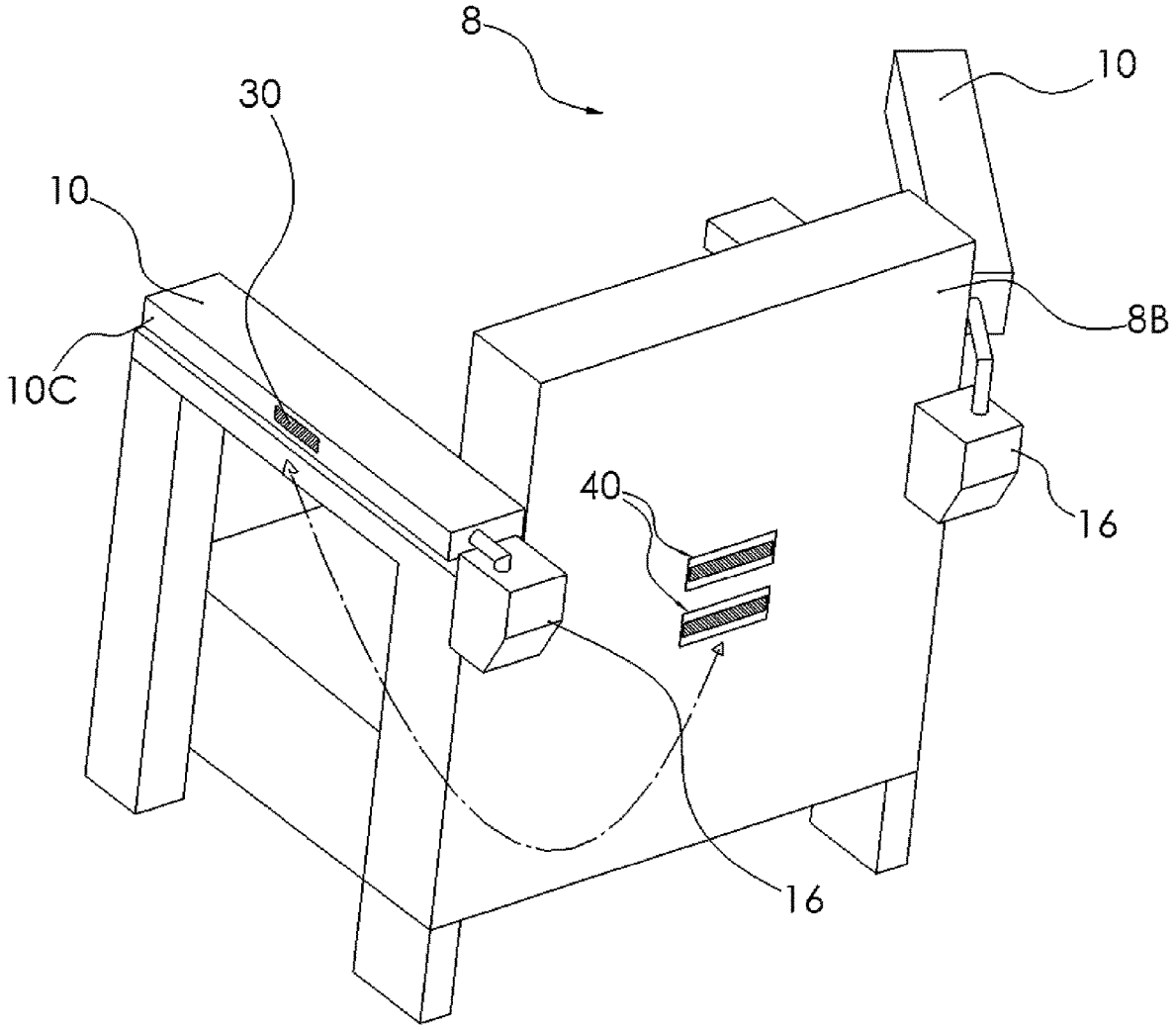
FIG. 5 depicts the swing arms in a mid-position between a rest and a stowed configuration

FIG. 5 illustrates the location of magnets 40 on the rear surface 8B of the chair 8. When the swing arms are rotated from their rest position to the rear surface of the chair, the magnets 30 on the swing arms 10 (see FIG. 3) and the magnets 40 are magnetically coupled to accomplish safe and compact storage of the swing arms. Magnet locations on both the arm rests and the rear surface are variable according to manufacturer's optimal location for a particular chair design. Other techniques for securing the swing arms to the rear surface 8B are known to those skilled in the art.

Figure 6:
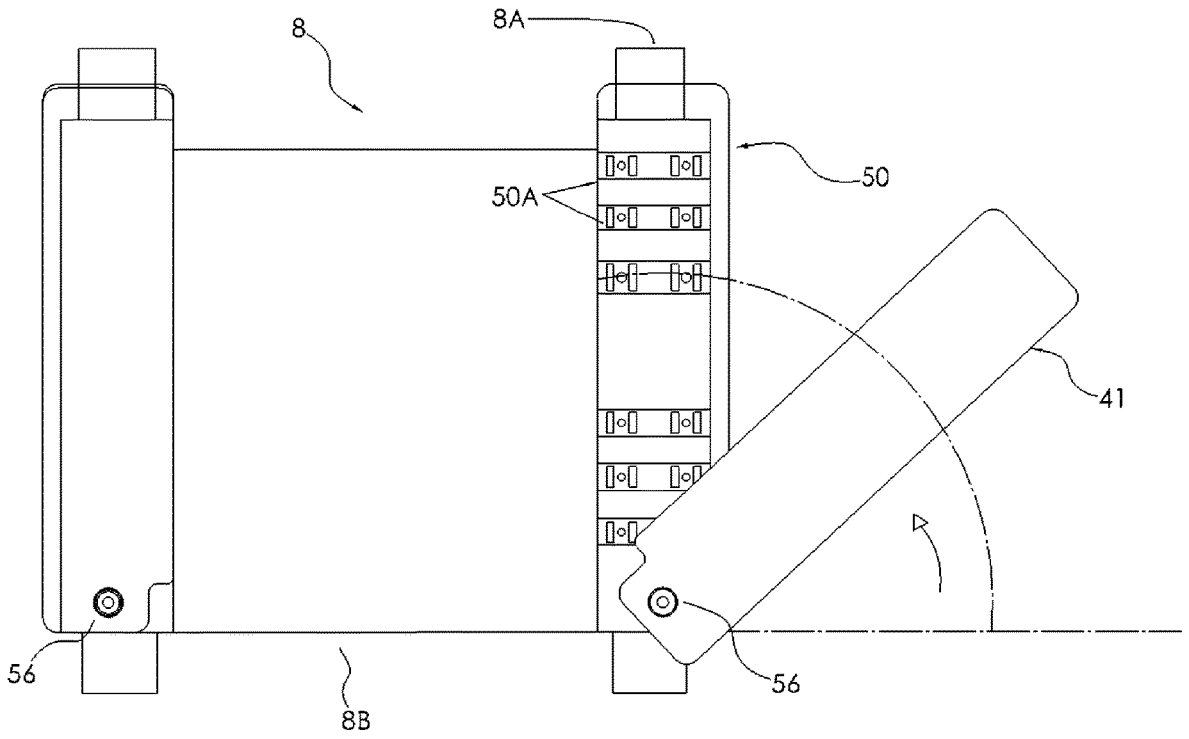
FIG. 6 illustrates an embodiment employing a base plate for attaching the swing arms to a chair.
Figure 7:
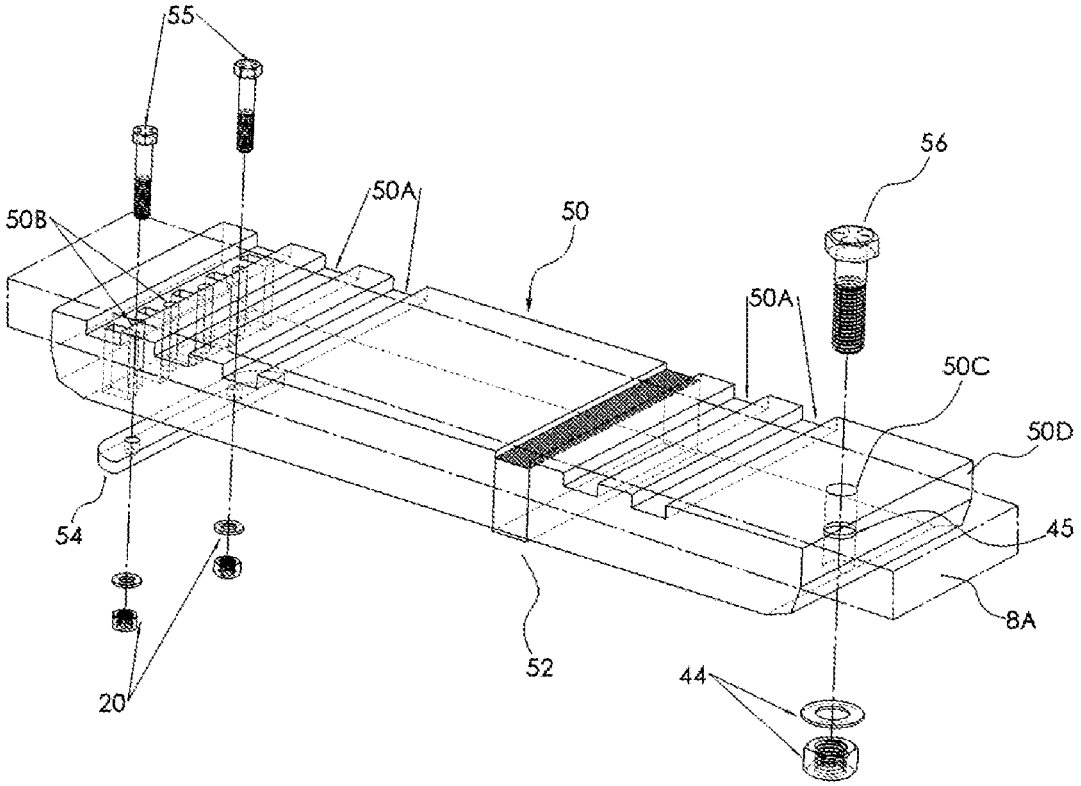
FIG. 7 illustrates the base plate for use in the FIG. 6 embodiment.

FIGS. 6 and 7, as described below, illustrate a technique for attaching the Swaybilizer swing arms to the arms of an existing chair using an intermediate base plate.

FIG. 6 depicts a swing arm base plate 50 attached to a right arm 8A of a chair 8. Swing arms 41 (comprising the arm rests 10) are rotatably attached to a rear portion of each swing arm base plate 50 with a bolt or shaft 56. This embodiment is particularly useful if a user desires to add the swing arms to an existing chair by attaching the base plate to existing chair arms. The Swaybilizer swing arms 41 attached to the base plate can then be rotated about the bolt or shaft 56 from a rest position overlying the base plate 50 to an extended or wing-like position in line with the chair back 8B.

FIG. 7 illustrates the base plate 50 in more detail and techniques for mounting the Swaybilizer swing arms 41 (see FIG. 6) to a top surface of a conventional existing chair arm 8A by attaching the base plate 50 intermediate the swing arms 41 and the chair arms 8A (see FIG. 6). Use of the base plate allows the Swaybilizer swing arms 41 to be mounted to almost any chair.

In one embodiment the base plate 50 is securely attached to existing conventional chair arms 8A using Velcro® (a registered trademark of Velcro IP Holdings LLC, with headquarters in the United Kingdom) straps 52 that encircle the chair arm, i.e., the straps 52 are received within one or more of the spaced-apart notches 50A in the base plate 50 and encircle the chair arm. The notches are spaced along the base plate to offer a wide selection of Velcro® mounting locations according to the curvature, design, and length of the user's existing conventional chair arms. The spacing allows securing the Velcro® straps 52 around small, medium, and large existing conventional chair arms. A depth of the notches allows the Velcro® strap 52 to set below the plane of the base plate to thereby allow the swing arms 41 to swing freely without interfering with the base plate.

Alternatively, an optional bolt-on clamp plate 54 serves as a clamping mechanism for attaching the base plate to the chair arm. The bolt-on clamp plate 54 is installed using mounting hardware parts such as machined shank bolts, washers, and locknuts to firmly secure the swing arm base plate 50 to a conventional chair arm.

Specifically, the clamping plate 50 is positioned on a lower surface of the chair arm. Two (or more) shank bolts 55 pass through any two of the several holes 50B located in each the recessed notches 50A, pass through holes in the clamping plate 50, and are secured with mating nuts 20 on the lower surface of the chair arm.

Preferably, two clamp plates 54 are installed for each base plate 50. The clamp plates can be spaced apart to properly secure the swing arm base plate 50 to the arms of a conventional chair.

A bolt or shaft 56 passes through an opening 50C defined at an end 50D of the base plate 50 and serves as the pivot point for the swing arms 41. The bolt or shaft 56 must be of the proper shank length that is equal to the height of the arm rests for smooth movement of the Swaybilizer swing arm. Proper tensioning of the force required to allow the sitting user to move the swing arms can be achieved by adjusting the tightness of the locknut and washer 44, which are disposed in an opening 45 in the base plate.

In the various described embodiments, the swing arms can be attached to an existing chair, while in other embodiments the swing arms are molded-in or built-in to the chair by the chair manufacturer. In the latter case, the chair material comprises plastic, a strengthened composite, metal, or wood that is compatible with the materials of the chair design.

Figure 8:
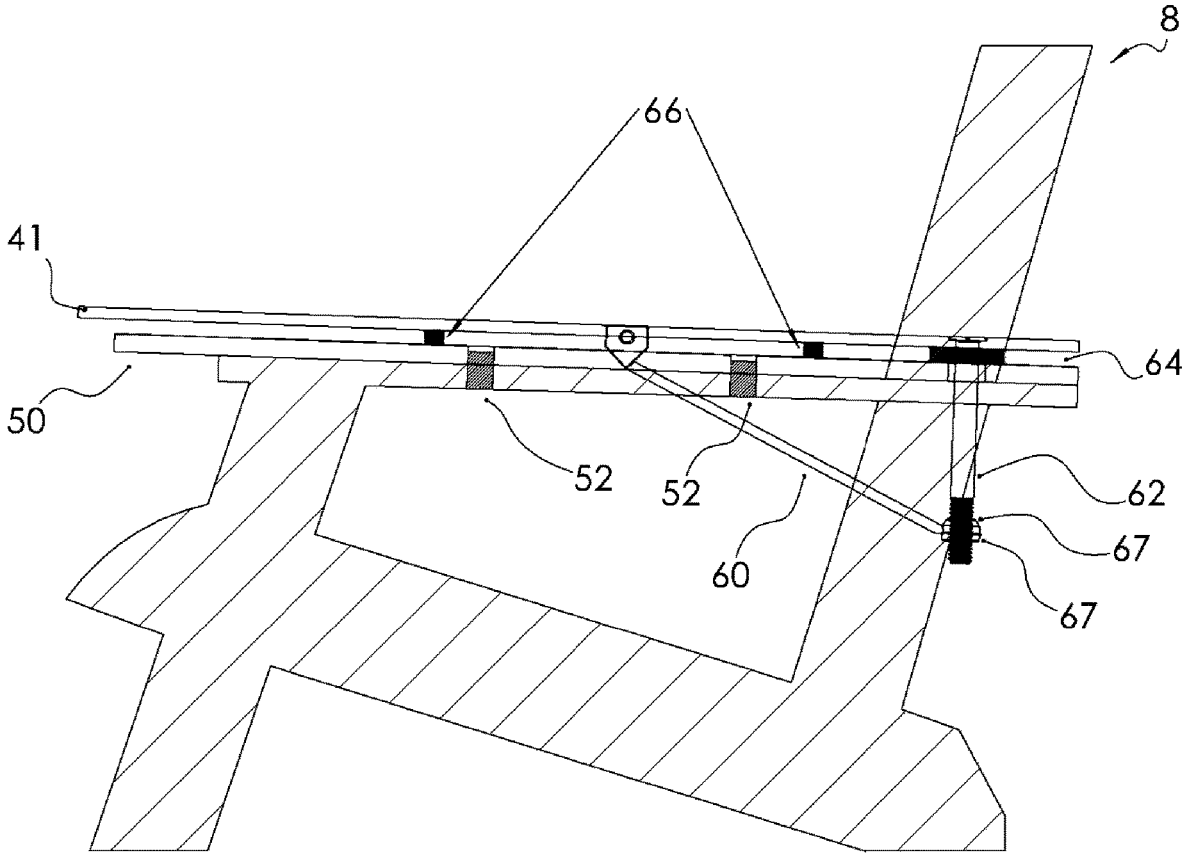
FIG. 8 illustrates a side view of a chair with attached swing arms according to the embodiment of FIG. 6.

FIG. 8 illustrates a swing arm upright brace 60 for use with the Swaybilizer swing arm 41 when attached to a conventional chair via the base plate 50. The swing arm brace 60 attaches to the outside surface about at a mid-section of each swing arm, and to the bottom region of a swivel bolt 62 with mounting hardware. The brace 60 supports the weight of the sitting user's arm and upper torso as the swing arm is rotated away from its rest position atop a chair arm.

The brace 60 (one brace for each swing arm) is used typically only with chairs made of a solid material such as wood, strengthened composite, or metal. Other techniques for proper bracing may be implemented by manufacturers of plastic chairs or chairs constructed of less rigid material.

To best achieve the functional motion of the Swaybilizer swing arms for a chair, chair manufacturers can mount the swivel-point of the swing arms in any location on the chair. Similarly, the brace 60 can be attached at any location along the underside or side surface of the swing arm.

FIG. 8 also illustrates two facing nylon lock nuts 67 that are designed to maintain their rotational position and therefore do not loosen on rotating assemblies. In the FIG. 8 embodiment the nylon lock nuts 67 hold the brace 60 in position on the swivel bolt 62, which rotates as the swing arm 41 moves from its rest position.

FIG. 8 also illustrates bevel-cut standoff spacers 66 located on an underside surface of Swaybilizer swing arms 41 and a spacer 64 through which the swivel bolt 62 passes. The spacers 64 and 66 create a small gap between the swing arm 41 and the base plate 50, so that rotation of the Swaybilizer swing arms avoids a pinching hazard.

Similar components to those illustrated and described relative to FIG. 8 are also attached to the other chair arm.

Figure 9:
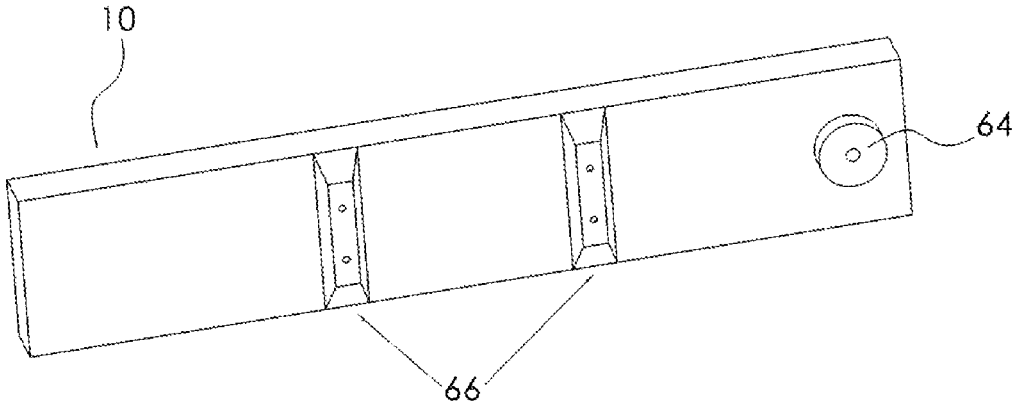
FIG. 9 illustrates a bottom surface of a swing arm for use in the embodiment of FIG. 6.

FIG. 9 illustrates the bottom surface of the swing arm 41 of FIG. 8, showing the bevel-cut standoff spacers 66 and the swivel bolt bushing spacer 64. Preferably, the spacers 66 and the bolt bushing spacers 64 are the same length. Each end of the bevel-cut standoff spacers 66 defines a chamfer to allow the swing arms 41 to seamlessly move past, onto, and over the top of the swing arm base plate 50 (see FIG. 8) without interference.

The bevel-cut standoff spacers 66 can be molded into the swing arm or attached separately to the swing arm using commonly available assembly hardware.

Stops to prevent movement of the swing arms into the sitting area of the chair may be implemented in the swing arm base plate 50 of FIG. 7, in the chair arms, or in the swing arms.

Figure 10A:
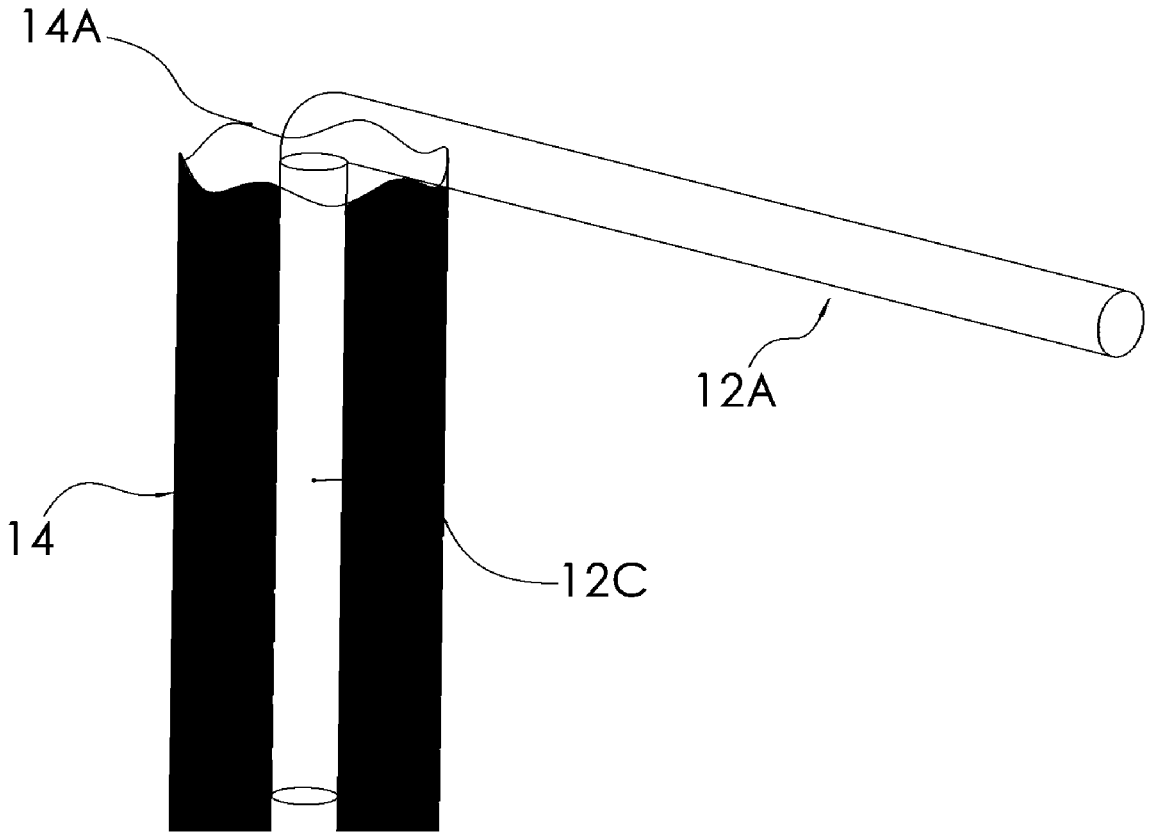
FIGS. 10A and 10B illustrate features of the thermoplastic tube of the present invention, as employed in the embodiment of FIG. 1.

Returning to the embodiment illustrated in FIGS. 1-5, a motion limiting feature is added to the top of the thermoplastic tube 14 (see FIG. 10A) in the form of knurled ridges 14A. The bent segment 12C moves across the raised and lowered segments of the knurled ridges 14A, as the sitting user moves the arm rests 10 inwardly or outwardly. The knurled ridges allow the swing arms to be moved in increments, according to the user's desired location for the arms.

Additionally, an inside diameter of the thermoplastic tube is manufactured to a predetermined tolerance that allows the arm rests 10 to be semi-tightly held in place, thereby holding the user's arm position until the user chooses to move the arm rests. These elements provide another motion-limiting aspect of the swing arms.

Figure 10B:
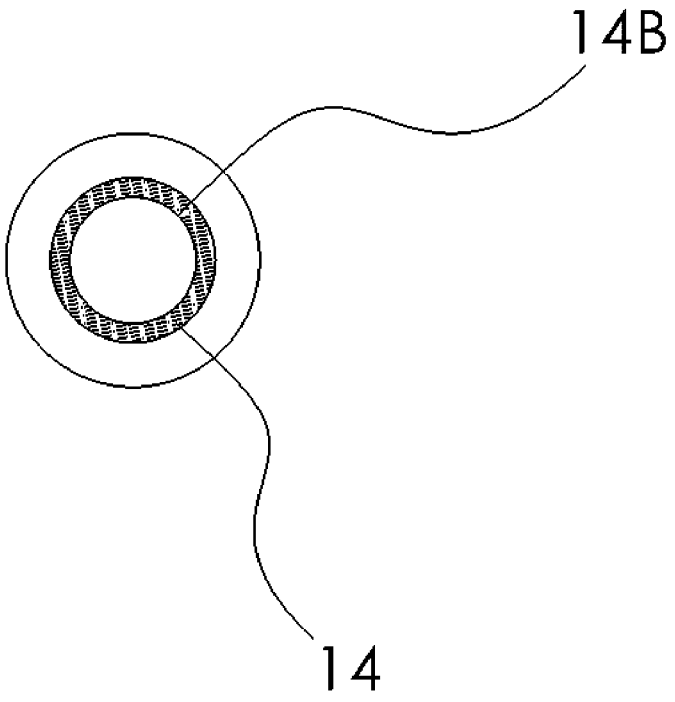

The top-inside diameter of each hole in the thermoplastic tube 14 defines a bevel cut 14B (see FIG. 10B) to allow seamless removal and installation of the bent segment 12C of the rod 12.

Figure 11:
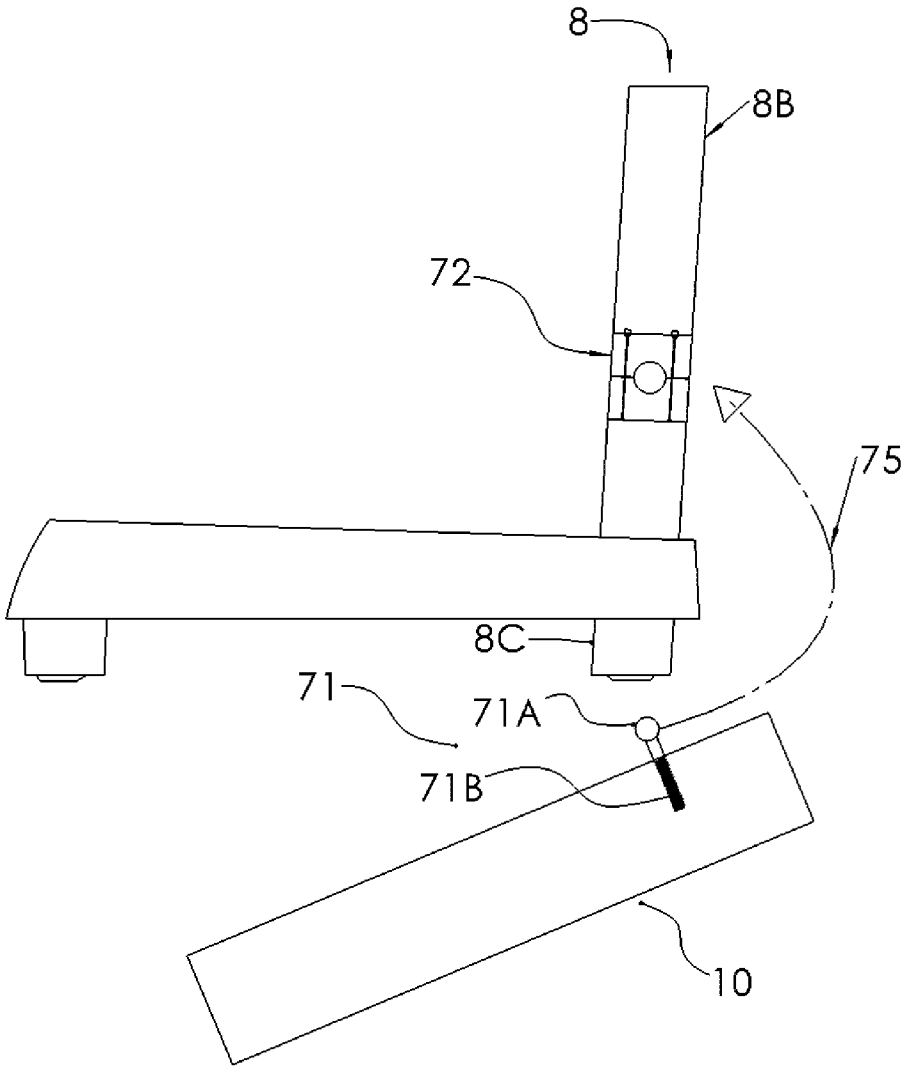
FIG. 11 illustrates yet another embodiment of the swing arms as attached to an existing chair.

FIG. 11 illustrates an optional mechanical assembly for attachment of Swaybilizer swing arms to the chair 8 with base feet 8C. This embodiment in particular may be utilized by a chair manufacturer. Thus, the location of the various components may be determined by chair design considerations.

A pillow-ball 71, comprising a ball 71A and a threaded shaft 71B, is threaded into a swing arm 10 as shown in FIG. 11.

Once threaded into each swing arm, the ball 71A is fit within a pillow ball case 72 of FIG. 11. Arrowhead 75 depicts mating of the pillow-ball and the pillow-ball case.

Figure 12:
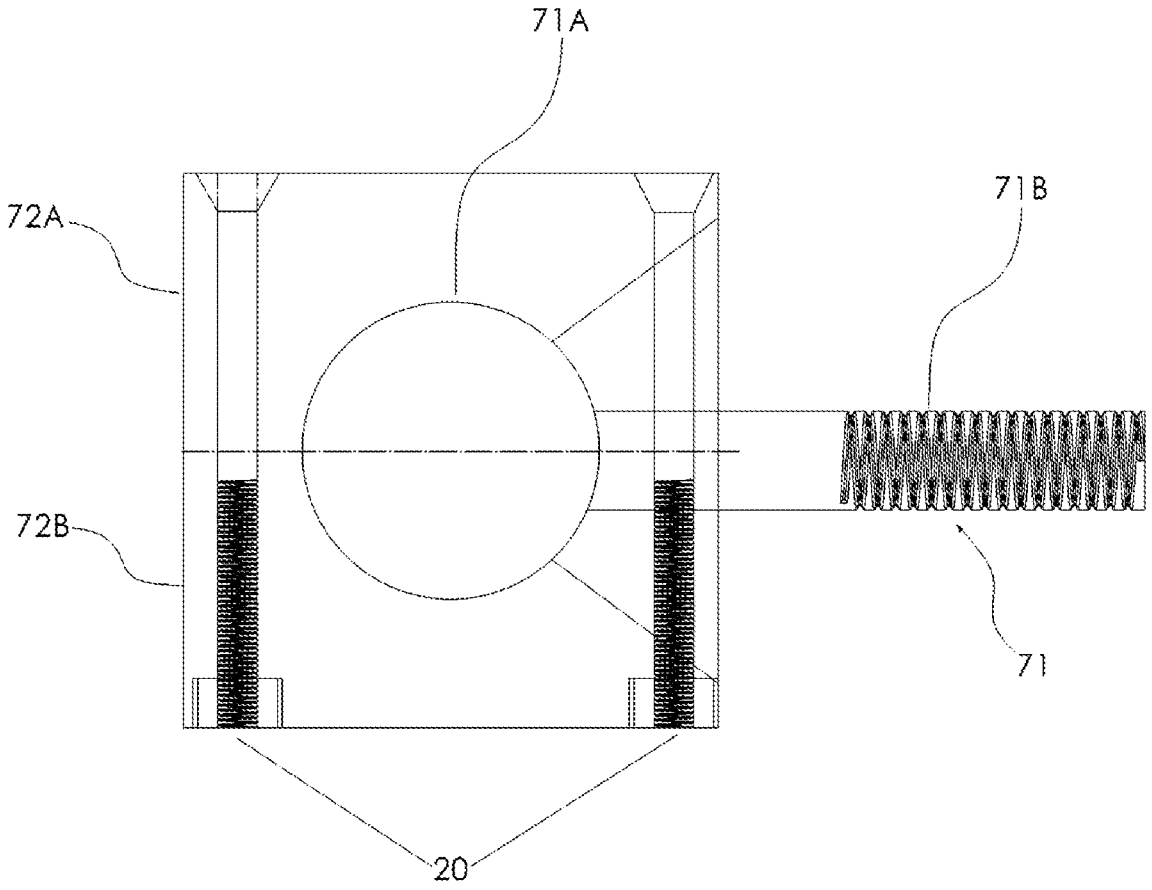
FIG. 12 illustrates a pillow ball and pillow ball case for use with the embodiment of FIG. 11.

As shown in FIG. 12, the pillow-ball case comprises a top section 72A and a bottom section 72B. As shown in FIG. 11, the pillow-ball case is located on the back side 8B of the chair 8. The two halves of the pillow ball case can be mechanically assembled with mounting hardware 20. See FIG. 12.

To properly tension the ball 71A, the user can adjust the mounting hardware screws and nylon locknuts associated with the pillow ball case 72 until desired tensioning of the swing arm 10 is achieved. The use of a pillow ball on each swing arm allows both vertical and horizontal motion of a swing arm as the ball rotates in two directions within the pillow ball case.

What is claimed is:

1. A chair, comprising:

a chair back;

a chair seat;

a left adjustable swing arm moveable between a rest position at 90 degrees relative to the chair back and an extended position at 180 degrees relative to the chair back, the left adjustable swing arm further comprising a left arm rest and a left arm rod further comprising a first segment and a second segment at 90 degrees relative to the first segment, the first segment of the left arm rod disposed longitudinally within left arm rest;

a right adjustable swing arm moveable between a rest position at 90 degrees to the chair back and an extended position at 180 degrees relative to the chair back, the right adjustable swing arm further comprising a right arm rest and a right arm rod further comprising a first segment and a second segment at 90 degrees relative to the first segment, the first segment of the right arm rod disposed longitudinal within right arm rest;

a left and a right swing arm support each attached to the chair back, the second segment of the left arm rod pivotably mounted to the left swing arm support to allow the left swing arm to pivot between the rest position and the extended position, the second segment of the right arm rod pivotably mounted to the right swing arm support to allow the right swing arm to pivot between the rest position and the extended position, wherein the left swing arm support defines a left-side opening extending downwardly therein, a left-side plastic tube pivotable within the left-side opening, and wherein the second segment of the left arm rod is disposed within the left-side plastic tube for allowing pivot motion of the left swing arm; and wherein the right swing arm support defines a right-side opening extending downwardly therein, a right-side plastic tube pivotable within the right-side opening, and wherein the second segment of the right arm rod is disposed within the right-side plastic tube for allowing pivot motion of the right swing arm.

2. The chair of claim 1, further comprising a left and a right motion-limiting element associated with a respective left and right swing arm.

3. The chair of claim 1, wherein a length of the first segment of the left arm rod disposed longitudinally within the left arm rest is adjustable and wherein a length of the first segment of the right arm rod disposed longitudinally within the right arm rest is adjustable.

4. The chair of claim 1, further comprising a left arm coupling element, a left chair back coupling element, a right arm coupling element, and a right chair back coupling element, wherein the left swing arm is pivotable to a position behind the chair back such that the left arm coupling element is attachable to the left chair back coupling element, and wherein the right swing arm is pivotable to a position behind the chair back such that the right arm coupling element is attachable to the right chair back coupling element.

5. The chair of claim 4, wherein the left and right chair back coupling elements and the left and right arm coupling elements each comprise a magnet.

6. A kit for attaching swing arms to a chair, the kit comprising:

a left base plate for attaching to a left arm of a chair;

a right base plate for attaching to a right arm of a chair;

a left swing arm for pivotable attachment to the left base plate and moveable between a rest position overlying a left arm of a chair and an extended position at about 180 degrees relative to a back of a chair;

a right swing arm for pivotable attachment to the right base plate and moveable between a rest position overlying a right arm of a chair and an extended position at about 180 degrees relative to a back of a chair; and a left-side and a right-side brace, a first end of the left-side brace for pivotable attachment to a distal end of the left bolt or rod and a second end of the left-side brace for attachment to an underside surface of the left swing arm, a first end of the right-side brace for pivotable attachment to a distal end of the right bolt or rod and a second end of the right-side brace for attachment to an underside surface of the right swing arm.

7. The kit of claim 6, further comprising a left and a right bolt or rod for pivotably coupling the respective left swing arm to the left base plate and the right swing arm to the right base plate.

8. The kit of claim 6, further comprising a left and a right hook and loop strap for attaching the respective left base plate to a left chair arm and the right base plate to a right chair arm.

9. The kit of claim 6, further comprising spacers for attaching to an underside surface of the left swing arm or for attaching to an upper-side surface of the left base plate to define an open space between the underside surface of the left swing arm and the upper-side surface of the left base plate, and further comprising spacers for attaching to an underside surface of the right swing arm or for attaching to an upper-side surface of the right base plate to define an open space between the underside surface of the right swing arm and the upper-side surface of the right base plate.

10. A kit for attaching swing arms to a chair, the kit comprising:

a left base plate for attaching to a left arm of a chair;

a right base plate for attaching to a right arm of a chair;

a left swing arm for pivotable attachment to the left base plate and moveable between a rest position overlying a left arm of a chair and an extended position at about 180 degrees relative to a back of a chair;

a right swing arm for pivotable attachment to the right base plate and moveable between a rest position overlying a right arm of a chair and an extended position at about 180 degrees relative to a back of a chair;

bolts and mating nuts and a left clamp plate, one or more bolts for passing through openings in the left base plate for engaging the left clamp plate disposed on an underside of a left chair arm and one or more nuts for engaging the one or more bolts for attaching the left base plate to a left chair arm, and further comprising a right clamp plate, one or more bolts for passing through openings in the right base plate for engaging the right clamp plate disposed on an underside of a right chair arm and one or more nuts for engaging the one or more bolts for attaching the right base plate to a right chair arm.

* * * * *